United States Patent [19]

Bratton

[11] 4,445,728

[45] May 1, 1984

[54] ALL WEATHER CLIPBOARD

[76] Inventor: Daniel W. Bratton, 3633 - 33rd Ave. South, Minneapolis, Minn. 55406

[21] Appl. No.: 49,575

[22] Filed: Jun. 18, 1979

[51] Int. Cl.[3] ..... A61G 11/00

[52] U.S. Cl. ..... 312/1; 108/23; 108/43

[58] Field of Search ..... 281/1; 108/43; 312/1; 224/222, 48 R; 206/214, 477; 160/DIG. 8; 15/235.4

[56] References Cited

U.S. PATENT DOCUMENTS

| | | | |
|---|---|---|---|
| 1,294,879 | 2/1919 | Davis | 160/DIG. 8 |
| 1,320,537 | 11/1919 | Dimond | 281/1 X |
| 1,320,840 | 11/1919 | Cambell | 108/43 |
| 2,482,589 | 9/1949 | Maguire | 224/222 X |
| 2,578,163 | 12/1951 | Whalen | 15/235.4 X |
| 2,685,638 | 8/1954 | Littrell | 281/1 X |
| 2,803,370 | 8/1957 | Lennard | 312/1 |
| 2,839,791 | 6/1958 | Lee | 160/DIG. 8 |
| 3,215,453 | 11/1965 | Malcom, Jr. | 108/43 X |
| 3,267,830 | 8/1966 | Gaasbeck | 312/1 X |
| 3,541,976 | 11/1970 | Rozas | 108/43 |
| 4,111,753 | 9/1978 | Folsom et al. | 312/1 X |

OTHER PUBLICATIONS

"Webster's Third New International Dictionary", G. & C. Merriam Company, Publishers, Springfield, MA, p. 1040.

*Primary Examiner*—James T. McCall

*Attorney, Agent, or Firm*—Orrin M. Haugen; Thomas J. Nikolai

[57] ABSTRACT

A clipboard assembly which may be used to facilitate the writing of messages and the like on paper in the out-of-doors under all types of weather conditions. The assembly includes a writing surface in the form of a base member to which is affixed a spring biased clip for holding one or more sheets of paper in place on the writing surface of the base member. A clear plastic housing surrounds the base member, the housing having a top panel and integrally formed side and rear panels which are joined to the base member to define an enclosed volume. The assembly may further include a fourth side wall which is hingedly secured to the top panel so that it may be rotated in a direction to permit access to the interior of the shroud so that the writing materials can be inserted and removed from beneath the clip. Means are provided for supporting the clipboard assembly on the non-writing arm of the user, the supporting structure including a hand grip member which also functions as a battery case for holding the batteries used to selectively energize a lamp for illuminating the clipboard for use at night.

5 Claims, 5 Drawing Figures

ALL WEATHER CLIPBOARD

BACKGROUND OF THE INVENTION

I. Field of the Invention

This invention relates generally to the design of a clipboard for facilitating the recording of data on paper and more specifically to the design of an all weather clipboard which may be used in most any environment encountered in the out-of-doors.

II. Discussion of the Prior Art

The most common form of clipboard comprises a generally rectangular sheet of a rigid material such as plastic or composition board onto which is secured a spring biased clip for holding the writing materials in place. When attempts are made to use such a device out-of-doors, obvious problems arise especially in a windy, rainy or snowy environment.

In the prior art there are described various devices for sheltering a writing surface so that records may be made out-of-doors. For example, in the Campbell U.S. Pat. No. 1,320,840 there is disclosed a recorder's shield having three side walls and an integrally formed top wall, one side wall being open to allow the user to insert his arm therein during the writing operation. In this arrangement, however, little or no protection is afforded against the cold, thus requiring the user to wear a mitten or glove which, of course, makes writing with a conventional pencil or pen unwieldy at best.

SUMMARY OF THE INVENTION

In accordance with my invention, there is provided a shield or enclosure for surrounding a writing surface, the assembly being both portable and providing a totally enclosed volume in which to conduct the writing operations. Specifically, the all weather clipboard to be described in greater detail herein includes a planar base member which is generally rectangular and which is provided with a spring biased clip on the upper (writing) surface thereof. An enclosure totally surrounds the base member and includes a top panel and three integrally formed side panels extending perpendicular to the top panel and defining three sides of the rectangular enclosure. A fourth side is hingedly secured to the top panel so that it may be rotated about its pivot point to permit access to the interior of the enclosure when it is desired to replenish a supply of paper or remove sheets. Otherwise, when in use, the hinged opening is closed relative to the base member and the mating side and top panels. The housing thus described is preferably formed from a clear plastic material to facilitate viewing of the writing surface as entries are made thereon. Furthermore, the fourth panel, i.e., the hinged panel, may have a generally circular opening formed therethrough into which is pivoted a spring biased door through which the user's arm may enter. Surrounding the opening and secured to the outer surface thereof is a weatherproof fabric cuff which precludes rain, snow or cold air from entering the otherwise sealed enclosure.

Formed on the bottom (exposed) surface of the base member is an attachment device for securing the clipboard to the non-writing arm of the user. For stabilizing purposes, a tubular handle or hand grip is provided, the hand grip serving as a convenient storage device for batteries used to power a lamp for illuminating the work surface. Thus, the device of the present invention may be used night or day and in all types of weather.

OBJECTS

It is accordingly a principal object of the present invention to provide a new and improved all weather clipboard for use by surveyors or the like.

Another object of the invention is to provide a shroud member for a clipboard which totally encapsulates the writing surface when in use.

Still another object of the invention is to provide an all weather clipboard including a battery powered lamp permitting its use in the dark.

A yet further object of the present invention is to provide a new and improved all weather clipboard which is inexpensive to manufacture but which is sufficiently durable to afford continued use over many years.

These and other objects and advantages of the invention will become apparent to those skilled in the art from the following detailed description of the preferred embodiment, especially when considered in conjunction with the accompanying drawings in which the same numeral in the several views refers to corresponding parts.

DESCRIPTION OF THE PREFERRED EMBODIMENT

Figure 1:
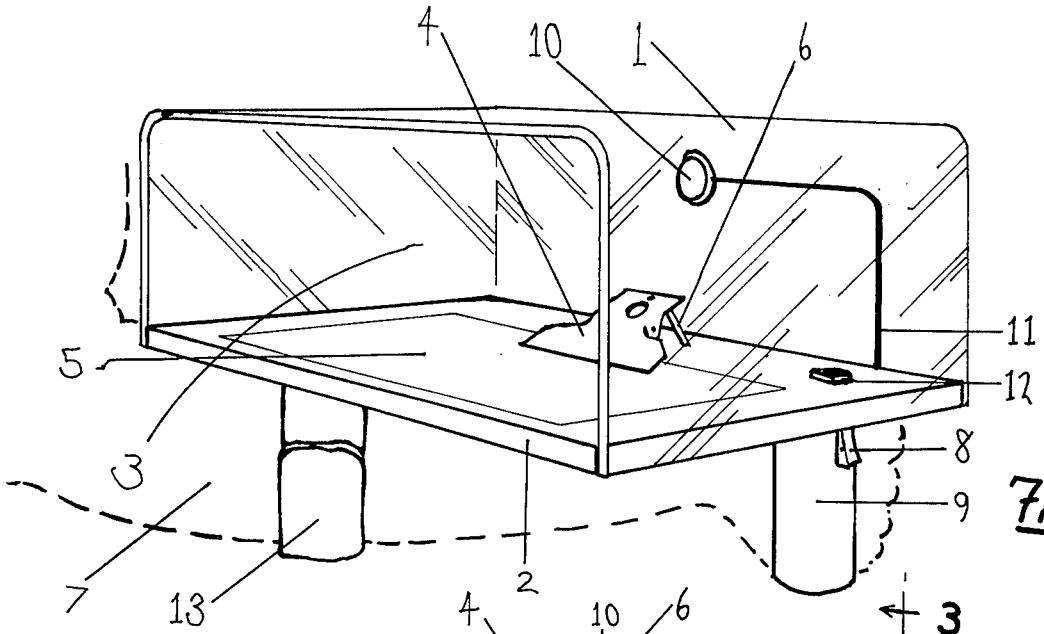
FIG. 1 is a perspective view of a first embodiment of the present invention.

Referring first to FIG. 1, shown in the perspective view is one embodiment of the invention and it includes a planar base member 2 which is generally rectangular and which has an upper surface (the writing surface) equipped with a spring operated clip member 4 which serves to hold one or more sheets of writing paper as at 5 in place on the writing surface. Affixed to the base member 2 is a clear plastic shroud 1 which includes a top panel and at least three downwardly extending side panels which join to the side edges of the base member 2 and define an open space 3 between the top panel of the shroud 1 and the writing surface of the base member 2. By forming the shroud 1 from a clear plastic material, the user may view the paper 5 to ensure proper recordation of data.

Figure 3:
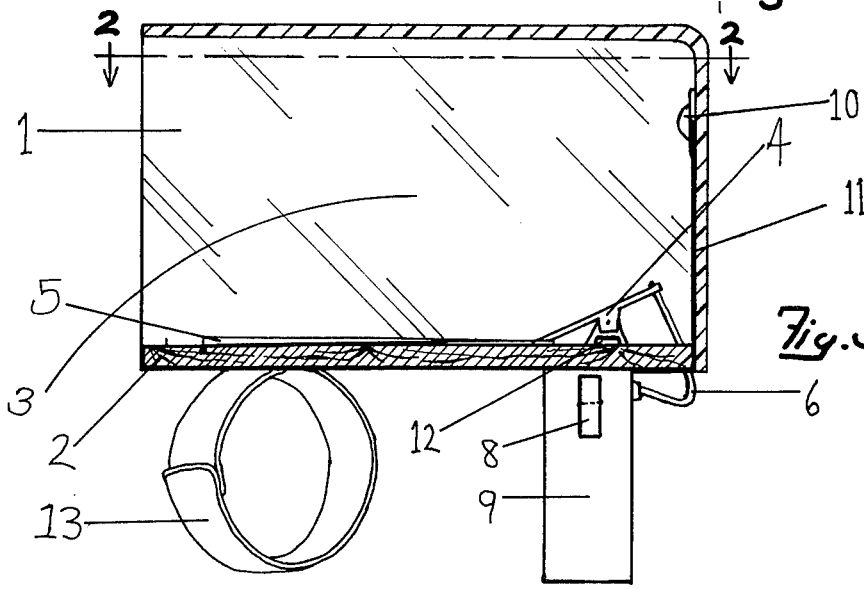
FIG. 3 is a cross-sectional view of the embodiment of FIG. 1 taken along the lines 3—3 in FIG. 2.

As may best be seen in FIGS. 1 and 3, a small hole is formed through the base member 2 just behind the clip 4 and passing through tne hole is a cable 6 which joins to the upper edge portion of the clip 4. This cable 6 is coupled to a hand grip member 9 which, in turn, is attached to the underside of the base member 2. Thus, the cable 6 forms a loop which permits the user to operate the clip from a point outside of the confines of the shroud itself. That is, by pulling downward on the loop portion of the cable 6 (see FIG. 3) the spring biased clip 4 will be rotated and the paper gripping edge thereof will be lifted to permit paper to be added or removed. To lower the clamping clip, the operator manipulates the clip cable release lever 8 on the handle grip portion 9.

It is apparent that the shroud 1 serves to shield the writing surface and permits entries to be made out-of-doors during inclement weather. In order to permit the device of this invention to be conveniently used at night or in places where the artificial illumination is minimal at best, there is included a lighting circuit including the lamp 10 which is coupled in circuit with a battery supply contained within the hand grip member 9 by means of the electrical conductor 11 and the on-off switch 12.

Figure 2:
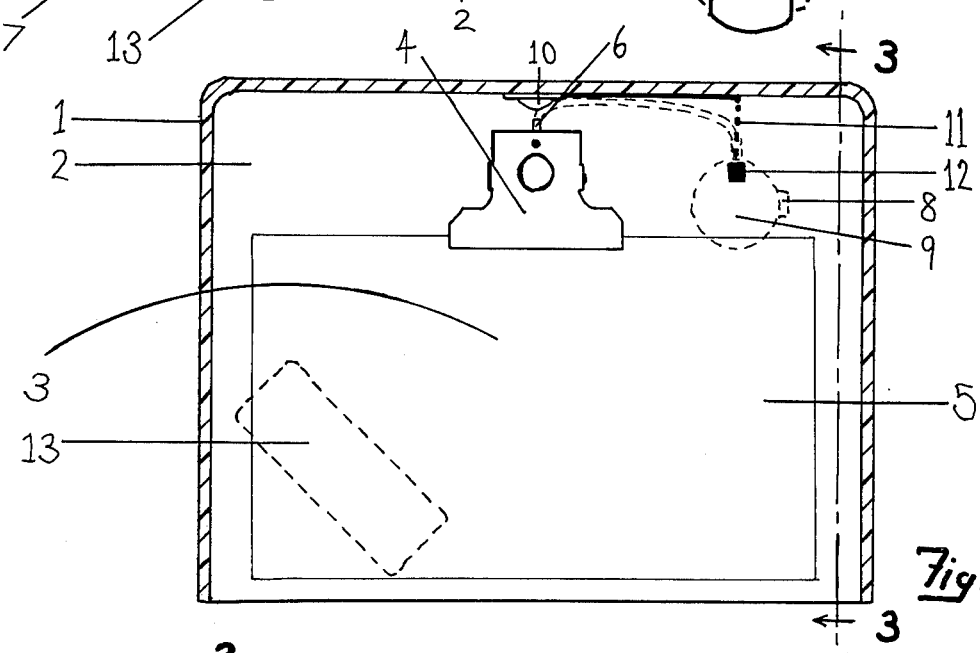
FIG. 2 is a cross-sectional view of the device of FIG. 1 taken along the lines 2—2 in FIG. 3.

Finally, completing the assembly illustrated in the views of FIGS. 1 through 3, it can be seen that there is affixed to the underside of the base member 2 a flexible strap 13 which may have a suitable separable fastener provided upon opposed surfaces to permit an arm encircling loop to be formed. It has been found that a separable fastener of the Velcro-type is readily suitable in that it provides a high degree of adjustability in the loop size. With reference to FIG. 1, it can be seen that the loop 13 is arranged to pass around the forearm 7 of the user, the forearm being represented in FIG. 1 by broken lines. Thus, by grasping the handle 9 in the non-writing hand of the user and having the strap 13 passed around his forearm, the clipboard assembly is constrained against tipping or rotation and a firm stable surface is afforded to the user for writing.

While the embodiment depicted in FIGS. 1 through 3 of the drawings provides a high degree of protection of the writing media 5 from the elements, it is basically open on one entire side wall thereof such that the possibility remains for rain or snow to enter, especially under windy conditions. To obviate this problem and to provide a more totally enclosed environment for the clipboard, the alternative embodiment illustrated in FIGS. 4 and 5 will prove helpful. In this arrangement, the shroud 1 surrounding the base member 2 is provided with a fourth side member 16 which is hinged along its upper edge to the top panel of the shroud as at 17. This hinge connection permits the side panel 16 to be swung inwardly of the enclosure 3 to facilitate the insertion and removal of writing materials. Formed proximate the base member 2 is a latch 18 which normally holds the fourth side 16 in its generally vertical orientation. The latch 18, when released, permits the panel to be pivoted about its hinge 17.

Figure 5:
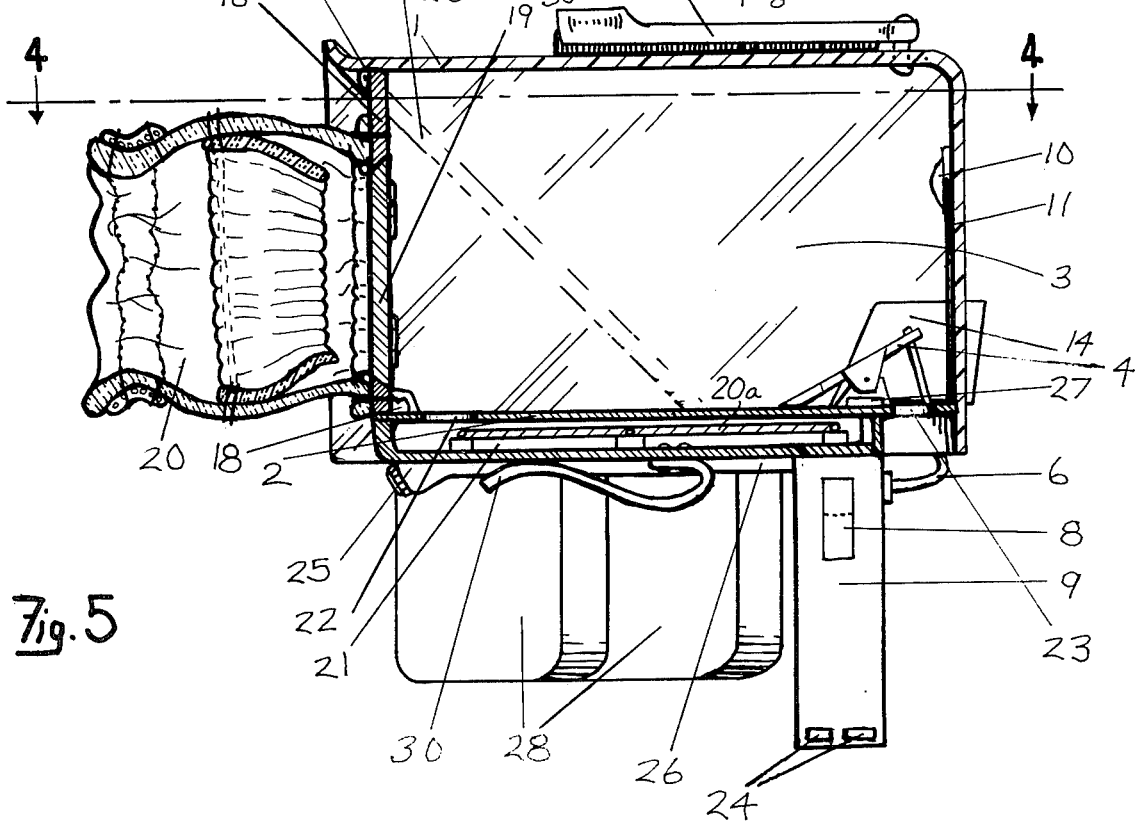
FIG. 5 a cross-sectional view taken along the lines 5—5 in FIG. 4.

Also formed in the fourth side wall 16 is a generally circular opening into which is fitted a circular door 19, the door 19 being hinged about a vertical axis when viewed as in FIG. 5. The hinge arrangement is provided with a suitable spring to normally urge the door 19 into a closed relationship with respect to its opening. The door 19 provides an access opening for the hand and forearm of the user, but when the arm is removed, the door 19 will swing shut and provide a fully protected environment for the interior of the shroud.

To provide further added protection such as during rain and snow conditions, it is proved expedient to attach a waterproofed fabric cuff 20 having one end thereof secured to the outer periphery of the opening defining the doorway 19. An elastic band surrounding the cuff 20 may be used to cause the cuff to securely engage the forearm of the user, thereby providing a weatherproof seal.

Figure 4:
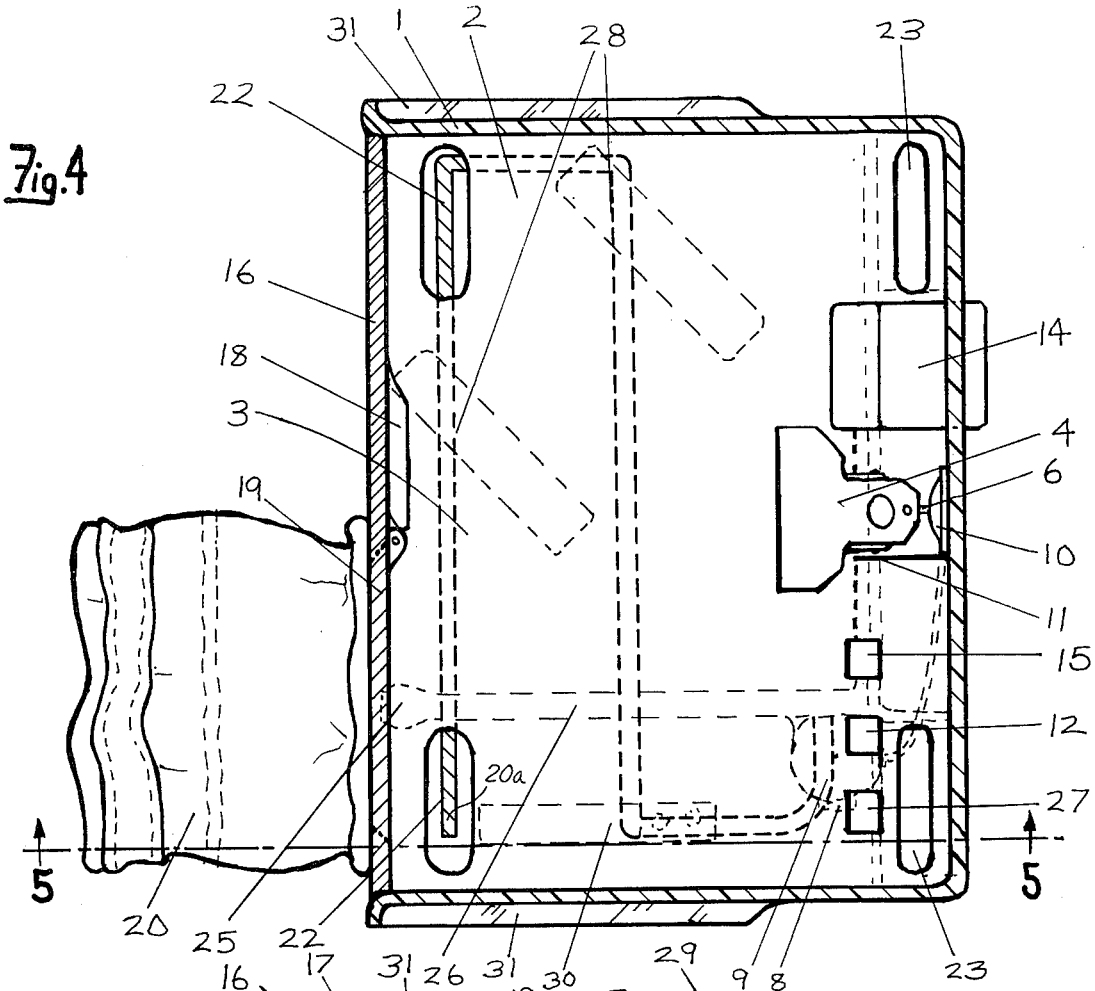
FIG. 4 is a cross-sectional view of an alternative embodiment taken along the lines 4—4 in FIG. 5.

To adapt the embodiment of FIGS. 4 and 5 to cold weather use, a heating element **20*a* can be inserted in the air space 21 beneath the board 2, the underside of the board 2 having a hollowed-out compartment therein as indicated in FIG. 5. Power for the heating element may be a battery pack carried by the user and connected to the all weather clipboard assembly by way of the electrical connector jack 25. The heated air within the compartment 21 may then enter the volume 3 by way of the vents 22 formed in the base member 2 at locations which are out of the area normally occupied by the writing paper 5. Outlet ports 23 are provided through the base member 2 through which air may flow to prevent the build-up of condensation which may otherwise cloud the clear plastic surface of the shroud 1 and obscure vision. A push button switch 27 is connected in series between the conductor 26 which connects to the jack 25 and the heater element (not shown). Hence, by opening or closing the switch 27, it is possible to complete the circuit to the resistance heater from a location within the enclosure 3**.

As in the embodiment of FIG. 1, the arrangement shown in FIGS. 4 and 5 also includes a handle member 9 which may be grasped by the user's non-writing hand. Rather than employing a flexible strap as in the arrangement of FIG. 1, however, first and second generally parallel blocks 28 are provided, the blocks being parallel to one another and spaced apart so as to normally fall on opposite sides of the user's forearm. These downwardly depending blocks along with the handle 9 permit the user to maintain the all weather clipboard in a stable orientation during the writing operation.

With reference to FIG. 5, numeral 24 refers to inlet vents formed at the base of the handle member 9. Air enters these vents and flows upward into the space 21 formed in the base member 2 of the clipboard assembly. Numeral 30 is a spring clip secured to the underside of the base member 2, this clip serving as a convenient means for suspending the user's mitten or glove while his hand is disposed within the shroud for recording information.

In addition to the interior light 10 and its associated battery supply contained within the handle 9 and the switch 12 for coupling the supply to the lamp 10, there is also provided an exterior lamp assembly 14 which is wired to the jack 25 by way of an on-off switch 15. Thus, energization for the outside lamp 14 comes from the portable battery pack carried by the user and which is coupled to the electrical devices used in the all weather clipboard by way of the connector jack 25.

While not essential to the overall operation of the preferred embodiment, it may be convenient in some instances to provide a squeegee or wiper member 29 which is pivotally secured to the upper panel of the shroud 1 and which is manually operable or operable through a small electric motor (not shown) to remove water, dust, or snow and to thereby improve the visibility. Likewise, there may be integrally formed on the exterior surface of the left and right side walls a downwardly sloping projection as at 31, this projection serving as a deflector which routes rainwater or the like toward the forward edge of the all weather clipboard so that it does not fall on the feet of the user.

While I have shown and described first and second alternative embodiments of the invention, it is to be understood that those skilled in the art may arrive at various changes and modifications to the overall structure which squarely fall within the intended scope of the invention. For example, to assist the flow of warm air through the enclosed volume, it is possible to locate a small motor driven fan within the housing 9 to assist the normal convection currents. Furthermore, the device of the present invention can be used for other than facilitating a writing operation. For example, where chemical analyses and the like must be conducted out-of-doors, suitable clips and the like can be installed within the shroud for supporting test tubes and other reactants. Furthermore, the location of certain of the parts may be varied, such as the location and disposition of the handle member 9 and the strap 13 or the downwardly depending blocks 28. In this fashion either a right-handed person or a left-handed person may be accommodated. As such, it is intended that the true spirit and scope of the invention be determined solely from the appended claims.

What is claimed is:

1. An all weater clipboard for out-of-door use comprising, in combination:

(a) a planar base member for providing a writing surface;

(b) a spring biased clip member mounted upon said base member and cooperating with said writing surface for holding a sheet to be written upon in place on said base member;

(c) a clear plastic shroud member having a top wall and at least three side walls depending generally at right angles to said top wall, said side walls being attached to the perimeter of said base member to space said top wall a predetermined distance above said planar base member;

(d) actuator means extending outside of said shroud for actuating said spring biased clip member;

(e) a tubular hand grip member extending generally normal from the underside of said planar base member; and (f) a battery powered lamp contained within said shroud for illuminating said sheet to be written upon, the battery for said battery powered lamp being contained in said tubular hand grip member.

2. The all weather clipboard of claim 1 and further including:

(a) a fourth side wall hingedly affixed to said top wall of said shroud member and inwardly rotatable to permit access into the space enclosed by said shroud member.

3. The device as in claim 2 and further including: an access port formed in said fourth sidewall; a spring biased door member hingedly mounted to selectively open or block said access port; and a flexible waterproof, fabric cuff affixed to the outer surface of said fourth sidewall in a sealing relationship and surrounding said access port.

4. Apparatus as in claim 1 and further including:

(a) a chamber disposed beneath said planar base member;

(b) means for introducing air into said chamber;

(c) heater means disposed in said chamber for heating said air; and (d) first vent means for introducing said heated air from said chamber into the space between said shroud member and said planar base member.

5. The apparatus as in claim 4 and further including:

(a) second vent means extending through said planar base member exterior of said chamber.

* * * * *